United States Patent [19]

Plattner

[11] 4,167,298

[45] Sep. 11, 1979

[54] BALANCED CABINET DOOR LIFT

[75] Inventor: Robert F. Plattner, Spring Lake, Mich.

[73] Assignee: Bastian Blessing Company, Inc., Phoenix, Ariz.

[21] Appl. No.: 870,445

[22] Filed: Jan. 18, 1978

[51] Int. Cl.[2] ..... A47B 88/00; B65D 43/24

[52] U.S. Cl. ..... 312/319; 312/138 R; 312/284; 217/60 R

[58] Field of Search ..... 312/333, 319, 271, 284, 312/290, 208, 138 R; 217/60 R; 16/1 R, 49

[56] References Cited

U.S. PATENT DOCUMENTS

| | | | |
|---|---|---|---|
| 425,891 | 4/1890 | Lehnbeuter | 312/138 R |
| 1,718,880 | 6/1929 | Ross | 312/290 |
| 2,758,900 | 8/1956 | Marchand | 312/319 |
| 2,790,690 | 4/1957 | James | 312/319 |
| 2,854,785 | 10/1958 | Sperlich | 312/284 |
| 3,049,390 | 8/1962 | Wolfe | 312/319 |
| 3,330,612 | 7/1967 | Masterson et al. | 312/319 |
| 3,785,452 | 1/1974 | Scott | 312/138 R |

FOREIGN PATENT DOCUMENTS

| | | | |
|---|---|---|---|
| 90262 | 2/1919 | Switzerland | 312/208 |

*Primary Examiner*—Victor N. Sakran
*Attorney, Agent, or Firm*—Watson D. Harbaugh

[57] ABSTRACT

A gravity closed, spring-biased, door control and hinge configuration located near the center of the top of a display cabinet wherein a spring attached to a lever extending from an L-shaped door is placed under tension when the door is moved to close a combined side-and-top dispensing opening.

3 Claims, 3 Drawing Figures

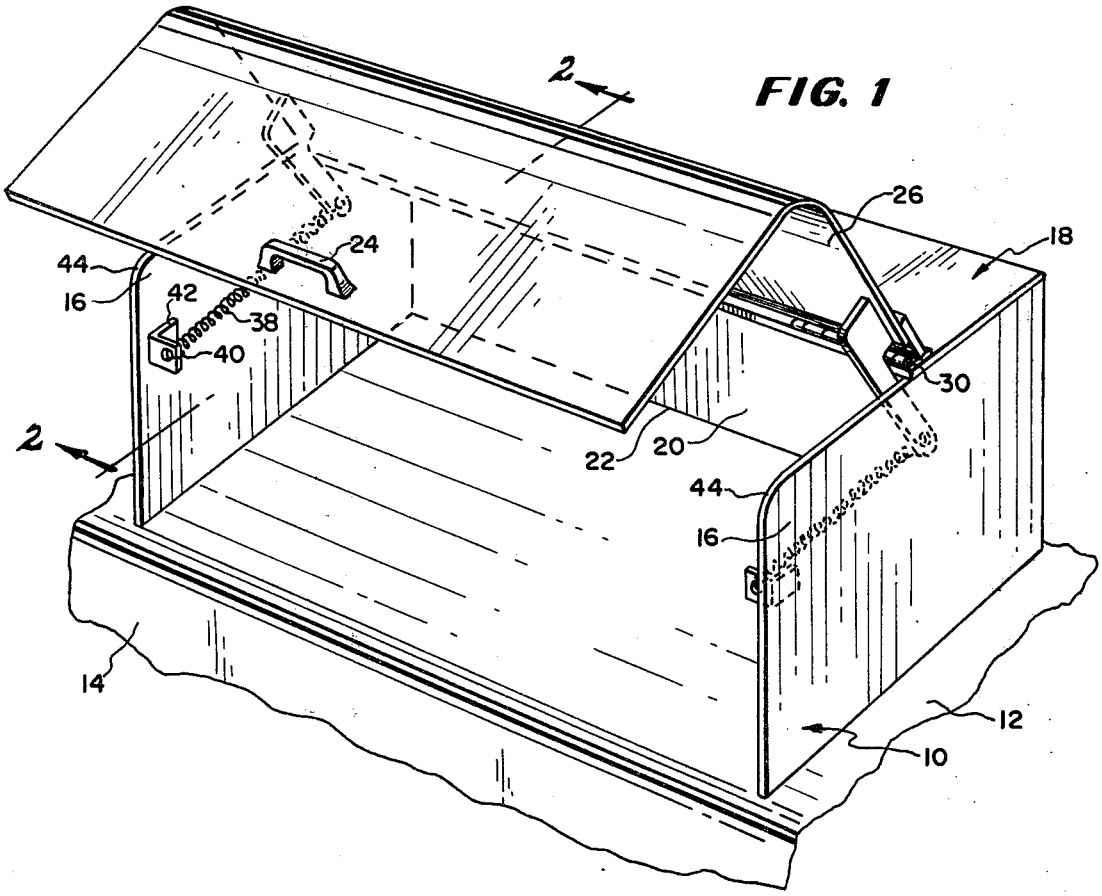
FIG. 1
FIG. 2
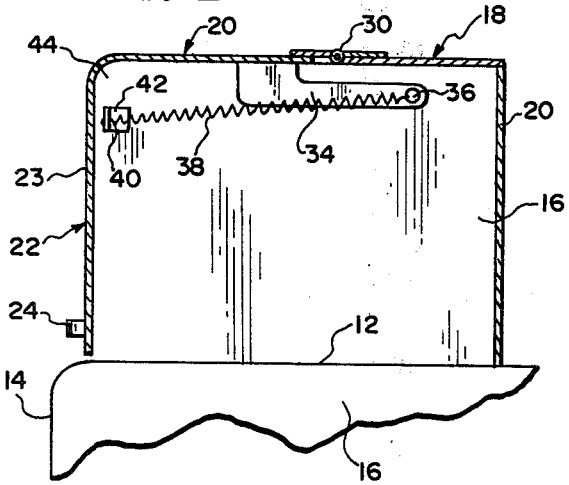
FIG. 3
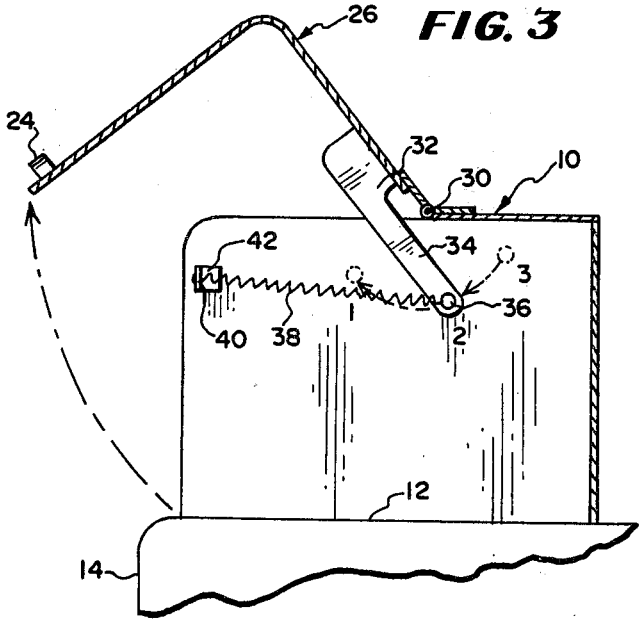

BALANCED CABINET DOOR LIFT

BACKGROUND OF THE INVENTION

Heretofore wide viewing and access openings have been lacking in the structure of self-service food and display cabinets, essentially because the walls have been made of rather heavy transparent plastic. Clarity of view has been impaired and viewers have not only had difficulty in visually examining and selecting products on display, but also in acquiring products offered for sale under self-service conditions where displayed in environmentally protective cabinets. Access doors on display shelves have been essentially eliminated due to their upright size and weight, and the shelves are generally elevated for viewing where such articles as food are readily open to dust and heedless human breathing and sneezing contamination.

Also, doors are left open when opened far enough for access and removal of a product, and if exposed food products are being kept cool, cooling is jeopardized. Weight of lift doors is also a factor.

SUMMARY OF THE INVENTION

In the present invention, the door lift weight for display cabinets may be as light as desired with adequate thickness for safety and clear vision, and although they can be opened fully by a waitress servicing the display cabinet, the normal use of the invention follows a human pattern in which the access opening is greatly increased vertically and horizontally without necessarily changing cabinet size. The initial opening of the cabinet is easily accomplished under lightened weight effects with increasing ease up to a degree that is satisfactory not only for vision but also inspection access, while also serving as a shield that can be returned to closed position with balanced ease. A full opening is quite easy to attain and maintain if servicing the cabinet, yet the access door closes easily and softly from a full opening. Both are assisted by gravity under machine-like conditions easily and directly controlled even by unskilled hands.

PREFERRED EMBODIMENTS

An object of the invention is to provide a food protecting dispensing cabinet having a self-closing door that is easily opened to clear a readily accessible expanse of cabinet for ready and easy viewing and removal of displayed goods, yet the door remains in open or closed position when left in full open or closed position.

IN THE DRAWINGS

FIG. 1 is a perspective view of the storage display cabinet with the door approaching its half way point of movement.

FIG. 2 is a cross-sectional view of line 2—2 of FIG. 1 of the cabinet.

FIG. 3 is a vertical cross-sectional view showing the door closed.

Referring now to the drawing in further detail a cabinet 10 is illustrated, preferably setting on a counter top 12 at one side of a food serving rail 14, and comprising two upright end wall members 16 substantially rectangular in shape that are supported in spaced and squared relation by a middle section having top and back side portions 18 and 20, respectively. The cabinet may be furnished with or without a bottom member (not shown). The top portion 18 is preferably only wide enough, front to back, to secure and hold the vertical sides 16 and 20 square and rigid and pivotally support the door 22.

Preferably the door 22 is L-shaped, defining a front side 23 carrying a handle 24, preferably near the bottom edge to decoy finger prints and a remaining horizontal portion 26 permanently mounted at its upper rear edge 28 for free pivotal movement about a horizontal axis 30. In a full open position the bottom of the top 26 can become an upwardly facing shelf for the open display of articles, if desired, without any strain upon the working elements when left fully open.

Two brackets 32 are secured to the top portion 26 and have two spaced arms 34 extending rearwardly beyond and below the hinge 30. They have openings 36 that pivotally support the rear ends of respective tension springs 38. The front ends 40 of the springs are supported on brackets 42 that are secured to the end walls 16 adjacent to the corners 44.

The tension and disposition of the springs 38 are such that they provide a varying triangulation of effort between the ends of the arms 34 at openings 36 and the bracket 42, the hinge axis 30, and the ends of the arms at 36, whereby the spring gives support to the door at any level desired up the position where the front part 22 is horizontal or a little therepast. In this position tension still exists on the spring 38 to support the overhanging leverage-like weight of the vertical portion 22 of the door when horizontal or slightly higher. Thus, in such position the weight of the front portion 22 balances a predetermined remaining tension in the spring 38, the tension lessening more rapidly than the center of weight of the door as the center of gravity thereof passes over the door pivot axis 30 at a point beyond which there is minimal further movement. The point of equalization can be determined by the force rate of the spring 38 and if desired such can be varied by the designed length or wire size of the spring.

The lowering of the door 26 moving in the closing direction stretches the spring 38, and progressively foreshortens the effectiveness of the point 30 of the pivot with respect to the two ends of the spring 36 and 40 when the door is closed. This spring stretch increases but is more rapidly fore-shortened by the pivot being positioned between the ends of the spring end to gain a leverage securement advantage.

Referring diagrammatically to FIG. 2, the spring 38 in the door lowered position is fully stretched to the position 36-3 as shown in FIG. 3 but is not strong enough with its foreshortened reduced angle (30–36–40) to lift the major weight portion of the door 22. With the door 22 in a desired open position 36-2 (FIG. 2) the door load is lightened enough, with respect to its effective weight being essentially carried by the pivot 30, for the spring to hold the door in that elevated position. Then when the effective moving tension point of spring is at 36-1 (FIG. 2), as when further shortened to almost its solid state between anchor 42 and point 36-1 (FIG. 2), the door by its own weight remains open. The balance point of spring tension effort and door weight is at approximate point 36-2 in the position shown in FIG. 2. However, there is adjustable leeway with the point 26-3 so that the door can be higher at rest, if desired, with a tension adjustment (not shown) at 42 or 36.

In brief, when the door is closed, the spring 38 is stretched to a maximum tension almost horizontally parallel to the short leg 26, but its foreshortened effort exerts a lesser effect upon the door when being opened but to a better advantage when the arm on the door moves the spring tension application point away from the toggle advantage of its resting position to increase its leverage effort for the spring to carry the weight of the door and orient itself to hold the door 26 in open position with very little spring effort for easy closing.

Thus, as far as the operation of the door is concerned, it is easy to open and easy to close since the center of weight of the door is moved approximately vertically with the spring operating essentially to lightly support the door easily as the center of the door load shifts with its movement and with no load when shut or open.

The cabinet is preferably made of plexiglass or clear polystyrene having good optics and sufficient thickness to be ruggedly cooperative with the spring 38 and the action of the arm 32, either of which are of computed length and strength to transverse the full angle of movement yet strong enough at given stretch lengths to provide the amounts of force desired, the anchor point 42 being shiftable about the pivot axis 30 to provide sufficient leeway of design for cabinets of different lengths and thicknesses of polystyrene.

A stop can be provided, if desired, to prevent the top moving to its full open position, and, if desired a second spring or dash pot can be connected to the end walls and the arm effective to cushion the action of any spring at any angle or range of movement of the arm.

Moreover, with the cabinet rigidity provided by the top portion 18, a bottom wall can be omitted so that food displays can easily be arranged on the open counter top and the cabinet then set over them for the dispensing purposes discussed.

What is claimed is:

1. A self service display cabinet having a rectangular body including means defining an access opening extending through one vertical side and a part of the top wall adjacent thereto, a transparent L-shaped closure unit for the opening pivotally mounted proximate to the edge of the opening on the top wall for opening and closing movement about a horizontal axis, elongated lever arm means rigidly carried by the closure unit and extending horizontally under the remaining portion of the top wall and disposed normal to, but below, the level of said axis when said unit is closed, resilient means comprising tension springs interconnecting the inner end of the lever arm means and the sides of the cabinet adjacent to the opening portion in the front wall at a position proximate to the level of said inner end in its closed position but above the level of said inner end to resiliently support the cover as a unit when the cover is in an intermediate partially open position, wherein said top wall rigidly supports the sides and back wall, and the bottom of the cabinet is open, and manual means on said closure unit for manually actuating said closure unit.

2. The display cabinet defined in claim 1 in which the spring in its closed resting position provides an acute angle between it and the lever arm means.

3. The display cabinet defined in claim 1 in which the end walls determine the overall dimensions of the cabinet.

* * * * *